United States Patent [19]

Eklund et al.

[11] Patent Number: 4,994,092

[45] Date of Patent: Feb. 19, 1991

[54] HELIUM SMOKE GENERATOR

[75] Inventors: Thor I. Eklund, Haddonfield; James E. Demaree, Northfield; William E. Neese, Absecon, all of N.J.

[73] Assignee: The United States of America as represented by the Secretary of Transportation, Washington, D.C.

[21] Appl. No.: 371,883

[22] Filed: Jun. 27, 1989

[51] Int. Cl.[5] ..... C10L 5/00

[52] U.S. Cl. ..... 44/629; 252/305

[58] Field of Search ..... 44/629; 252/305

[56] References Cited

U.S. PATENT DOCUMENTS

| | | | |
|---|---|---|---|
| 2,633,455 | 3/1953 | Finkelstein et al. | 252/305 |
| 2,850,615 | 9/1958 | Luse, Jr. et al. | 252/305 |
| 2,882,240 | 4/1959 | Charwat | 252/305 |
| 3,250,723 | 5/1966 | Fortney | 252/305 |
| 4,439,341 | 3/1984 | Swiatosz | 252/305 |

OTHER PUBLICATIONS

*The Chemical Process Industries*, Shreve, R. N., 2nd Ed., McGraw-Hill Book Company, Inc., N.Y., 1956, p. 147.

*Primary Examiner*—Margaret B. Medley
*Attorney, Agent, or Firm*—Otto M. Wildensteiner

[57] ABSTRACT

A smoke generator which generates cold smoke having the buoyant properties of smoke produced by a fire. The density of the smoke can be varied to simulate any desired fire plume temperature by adding helium or other lighter than air gas to it. This produces a smoke which rises and spreads just like the smoke from a fire but without requiring that a fire be used to produce the smoke.

12 Claims, 1 Drawing Sheet

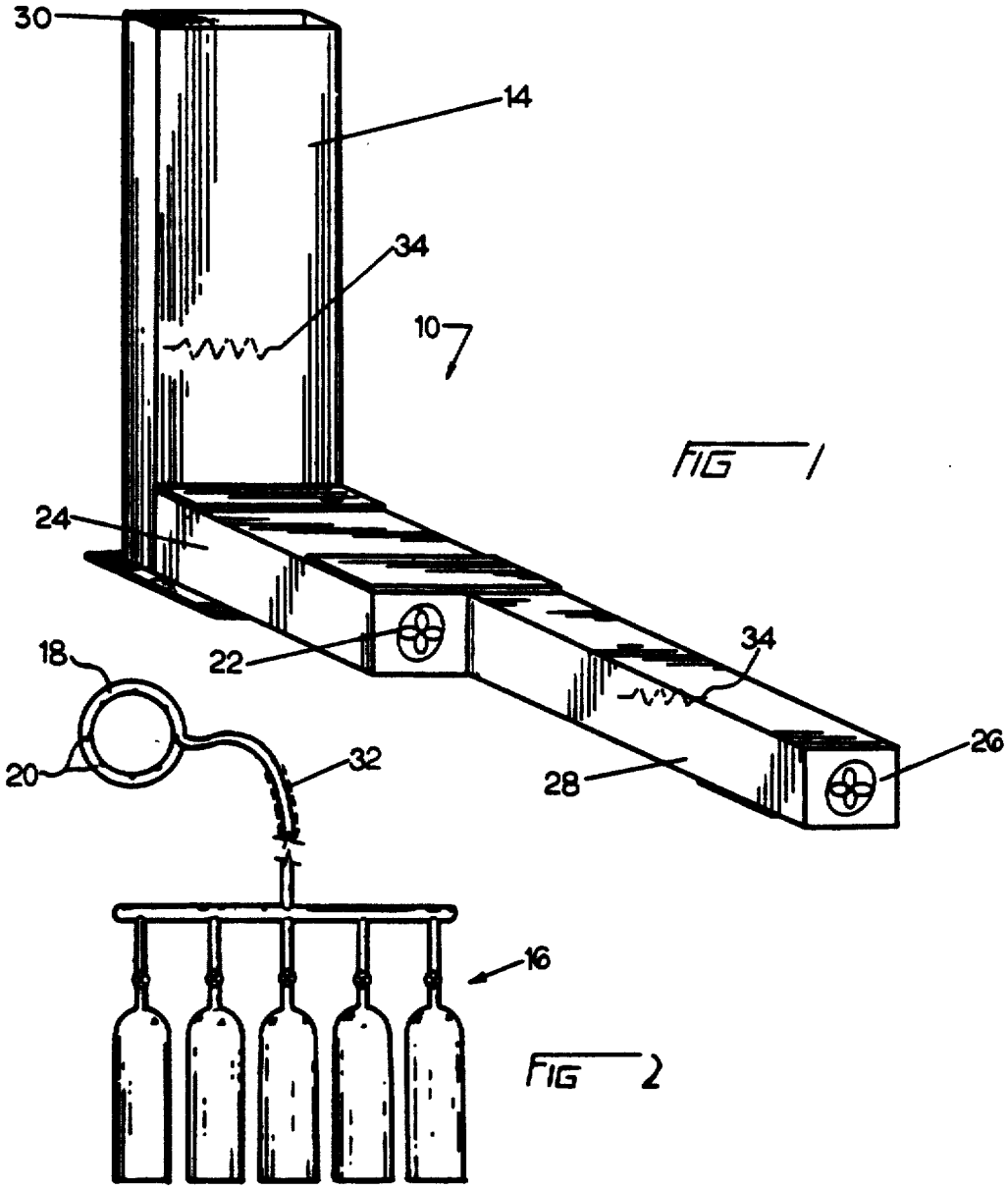
FIG 1
FIG 2
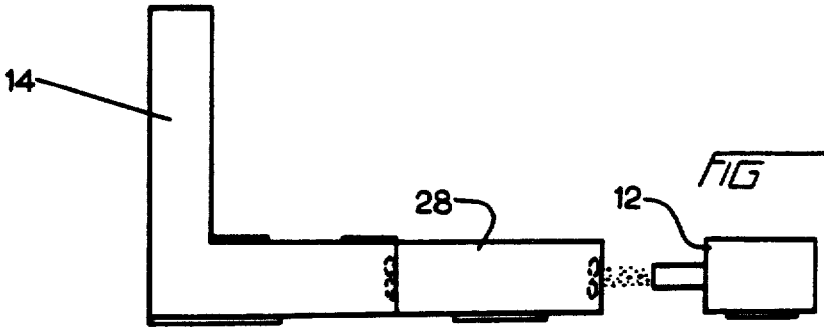
FIG 3

HELIUM SMOKE GENERATOR

STATEMENT OF GOVERNMENT INTEREST

The present invention may be made or used by or for the Government of the United States without the payment of any royalties thereon or therefor.

BACKGROUND

The present invention is a means and method for simulating the smoke and products of combustion of a fire which is burning at any desired temperature, without the release of any heat. It arose as the result of tests to investigate the way that smoke spreads within the passenger compartment of an airplane.

Initially, the smoke tests used a conventional theatrical smoke generator which generates a cloud of cold smoke (i.e. smoke nearly at room temperature). When the tests are performed in a real airplane, cold smoke has been traditionally used since it is obvious that setting a fire in an airplane is a rather expensive way to conduct such a test.

However, it was found that cold theatrical smoke does not spread the same way that real (i.e. hot) smoke spreads. Smoke from a fire rises up to the ceiling of the passenger compartment and then rapidly spreads fore and aft along the ceiling. By contrast, the cold theatrical smoke formed a cloud centered on the smoke generator which ultimately filled the cross section of the passenger compartment; it then gradually spread fore and aft, with its rate of spreading being a function of the rate at which the generator could produce "smoke" as well as of the direction and magnitude of the ventilation air currents near the generator.

This was a very unsatisfactory simulation since previous studies had shown that the smoke from a real fire spread along the ceiling, as discussed above. Accordingly, it was necessary to develop a smoke generator that produced cold smoke which had the same spreading properties as hot smoke from a fire.

SUMMARY

Briefly, the present invention is a smoke generator that mixes helium or other lighter than air gas with ambient air and smoke produced by a theatrical smoke generator. The resulting mixture has a density that is less than that of air, hence the mixture rises as though it were hot. Increasing the amount of helium or other gas in the mixture makes it rise faster, thereby simulating a hotter fire. Increasing the total flow of helium and air results in simulation of a larger fire.

Besides creating a buoyant mixture, the introduction of the low molecular weight gas also simulates the cabin air volumetric expansion associated with fires. This volumetric expansion is caused by the fact that heated gas at ambient pressure fills more volume than an equal mass of cool gas and can unbalance or change the ventilation air flow patterns within the airplane.

BRIEF DESCRIPTION OF THE DRAWINGS

FIG. 1 shows an overall view of the smoke generator of the present invention.

FIG. 2 shows the helium supply system for the smoke generator of the present invention.

FIG. 3 is a side view which shows the placement of the theatrical smoke generator with respect to the smoke generator of the present invention.

FIG. 4 shows the variation in apparent temperature with amount of helium.

OBJECTS OF THE PRESENT INVENTION

Accordingly, it is an object of the present invention to provide an improved smoke generator.

It is a further object to provide a smoke generator which produces smoke which rises as though it were at an elevated temperature but which in reality is cold (i.e. near room temperature).

It is a further object to provide a means and method of raising the apparent temperature of cold smoke to make it simulate the density of hot smoke.

It is a further object of the present invention to provide a means and method of producing smoke at room temperature which spreads as though it were hot smoke from a fire.

It is a further object of the present invention to provide a simulated hot smoke which is safe to breathe and which does not leave a residue.

It is a further object of the present invention to provide a means for simulating the cabin air volumetric expansion effects of a fire.

DESCRIPTION OF THE PREFERRED EMBODIMENT

FIG. 1 shows the improved smoke generator 10 of the present invention. It comprises conventional theatrical smoke generator 12 (see FIG. 3) the output of which is fed into mixing chamber 14 and a source 16 of helium or other lighter than air gas (see FIG. 2) which is also fed into mixing chamber 14.

Helium or other gas from source 16 is fed into the bottom of mixing chamber 14 through hollow circular manifold 18 shown in FIG. 2; holes 20 in manifold 18 distribute the helium evenly across the cross section of mixing chamber 14. Fan 22 pulls air into duct 24 and fan 26 pulls air plus the output from theatrical smoke generator 12 into duct 28, both of which feed into mixing chamber 14. As the air, smoke and helium rise inside mixing chamber 14 they form an even mixture having a density that is between the densities of pure helium and pure air. To insure a uniform flow of the mixture out of mixing chamber 14 reticulated rigid foam 30 is placed across the exit of mixing chamber 14. Reticulated foam 30 is Type I polyester safety foam manufactured by Scott Paper Co., Foam Division, Chester, Pa. Types II and IV would also work since they all have pore sizes of about 10–15 per inch and have about 97% open or void space.

For the present application the goal was an apparent temperature of 475 degrees F. and a total flow of 200 cubic feet per minute; this required approximately 50% helium. To achieve this the outputs from 5 helium bottles at 2500 psi, with their output pressure regulated at 50 pounds per square inch gage (psig), were fed into a piece of ½ inch copper tubing which in turn fed into manifold 18, which consisted of a piece of ¾ inch copper tube with 10 holes ⅛ inch in diameter drilled in it. The ½ inch copper tubing is connected to ¾ inch tubing 18 through a series of connectors and a bulkhead fitting through the wall of mixing chamber 14. The helium pressure immediately upstream of these fittings was 27.5 psig in this application. Control of the gas flow through manifold 18 is based on the use of a restriction as a sonic or limiting orifice such that the mass delivery rate of helium is proportional to the pressure upstream of the limiting orifice. In this application velocities from mixing chamber 14 were measured with portable hot wire type anemometers. The helium delivery was measured indirectly by measurement of the oxygen content of the air-helium mixture leaving mixing chamber 14 with an oxygen analyzer. Mixing chamber 14 is 36 inches tall and has a cross section of 12 inches by 12 inches. Ducts 24 and 28 have cross sections of 5 inches by 5 inches; duct 24 is one foot long and duct 28 is three feet long. The speeds of fans 22 and 26 were adjusted to produce a velocity of 105 feet per minute at the outlet of mixing chamber 14 without the addition of any smoke or helium; when the smoke and helium were added the resulting velocity was 200 feet per minute, giving the desired flow rate of 200 cubic feet per minute of simulated hot smoke.

It was found that if duct 28 were less than about 3 feet long the smoke from theatrical smoke generator 12 would impinge on the inside wall of mixing chamber 14 and form a coating on it rather than flowing up. Thus a length of about 3 feet allows it to mix with the air it is entrained in and flow out of the top of mixing chamber 14. It was also found that the use of 2 smaller fans rather than one large fan allowed more control over mixture ratios and airflow quantities; this is desirable since it allows the device to be used in a greater variety of applications.

Ducts 24 and 28 are separate until they reach mixing chamber 14; this was done for manufacturing convenience, and they could probably be combined into one single duct.

If desired, the helium or other lighter than air component can be heated before being fed into mixing chamber 14. This can be done by enclosing the tubing which carries it from the bottles to the smoke generator in a heater, shown by dashed lines 32.

Likewise, the simulated smoke can be heated by means of an electrical resistance heater or other heat source 34 placed within ducts 24 or 28 or mixing chamber 14. This will reduce the amount of helium required to decrease the density of the overall mixture without raising the temperature too much.

Two different smoke generators were used, the PRO 1500 and the PRO 3000, both made by Rosco Laboratories, Inc., Port Chester, N.Y. The only difference between them is the amount of smoke that they produce.

An advantge of using theatrical smoke is that it is harmless to breathe; further, it leaves no residue at the end of the test. This means that simulated fire evacuation tests can be conducted in a fully occupied airplane without harm to the passengers; it also means that an airplane can be put back into passenger service immediately after a test since there is no residue left on the interior surfaces.

The apparent temperature of the helium-smoke mixture can be calculated from the following equation:

$$\text{Percent helium} = 116[1 - T(amb)/T(app)]$$

where

T(amb) is the air temperature entering the simulator in degrees Rankine, and

T(app) is the apparent temperature of the mixture in degrees Rankine.

For an ambient temperature of 72 degrees Farenheit (532 degrees Rankine), the following apparent temperatures result from the following percents of helium:

| Percent Helium | Apparent Temperature |
|---|---|
| 37 | 325 F (785 R) |
| 44 | 400 |

-continued

| Percent Helium | Apparent Temperature |
|---|---|
| 50 | 475 |
| 55 | 550 |
| 59 | 625 |

This is shown in FIG. 4, which shows the amount of helium required for any desired apparent temperature between 325 and 625 F. at an ambient temperature of 72 F. Obviously, a different curve is required for a different ambient temperature.

The present system is for the addition of helium to the theatrical smoke; as stated earlier, however, any gas that is lighter than air can be used to lower the density of the mixture to simulate smoke at the temperature of a fire. When another gas is used, the orifice size for gas manifold 18 or the gas supply pressure and the percent of gas required for a given apparent temperature will have to be recalculated.

As shown in FIG. 3, theatrical smoke generator 12 was not directly coupled to the inlet of duct 28. It was placed a short distance from the inlet; the distance was chosen such that fan 26 pulled all of the output of theatrical smoke generator 12 into duct 28 along with a quantity of air.

Helium is the preferred gas for mixing with the output of theatrical smoke generator 12 since it is non-combustible. A mixture of a combustible gas with air would result in an explosive mixture and should probably be avoided.

As stated earlier, the smoke generator of the present invention simulates the cabin air volumetric expansion effects of a fire. In a fire, the cabin air expands due to the heat generated by the fire; this expansion can unbalance or change the air flows within the airplane. The additional mass flow of helium or other gas in the smoke generator of the present invention simulates this expansion, thereby giving a more realistic simulation of the actual airflow patterns which exist during a fire.

What is claimed is:

1. A smoke generator comprising means for generating smoke and means for raising the apparent temperature of said smoke.

2. A smoke generator as in claim 1 wherein said means for raising the apparent temperature of said smoke comprises means for adding a lighter than air component to said smoke.

3. A smoke generator as in claim 1 wherein said means for generating smoke is a means for generating cold smoke.

4. A smoke generator as in claim 2 wherein said lighter than air component is helium.

5. A smoke generator as in claim 2 further including means for heating said smoke.

6. A smoke generator as in claim 2 further including means for heating said lighter than air component.

7. The method of simulating the products of combustion from a fire at any desired temperature which comprises generating simulated smoke at a low temperature and adding thereto a component that is lighter than air.

8. The method of claim 7 wherein said lighter than air component is helium.

9. The method of claim 7 further including adding heat thereto.

10. The method of claim 7 further including heating said lighter than air component.

11. The method of simulating the cabin air volumetric expansion effects of a fire which comprises generating simulated smoke at a low temperature and adding thereto a component that is lighter than air.

12. The method of claim 11 wherein said lighter than air component is helium.

* * * * *